US009656474B2

(12) United States Patent
Arimizu et al.

(10) Patent No.: US 9,656,474 B2
(45) Date of Patent: May 23, 2017

(54) LIQUID EJECTION HEAD AND APPARATUS AND METHOD FOR PRINTING

(71) Applicant: CANON KABUSHIKI KAISHA, Tokyo (JP)

(72) Inventors: Hiroshi Arimizu, Kawasaki (JP); Ken Tsuchii, Sagamihara (JP); Nobuhito Yamaguchi, Inagi (JP); Yumi Komamiya, Kawasaki (JP); Arihito Miyakoshi, Tokyo (JP); Koichi Ishida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/057,929

(22) Filed: Mar. 1, 2016

(65) Prior Publication Data

US 2016/0257127 A1 Sep. 8, 2016

(30) Foreign Application Priority Data

Mar. 3, 2015 (JP) ..... 2015-041743

(51) Int. Cl.
*B41J 2/19* (2006.01)
*B41J 2/175* (2006.01)
*B41J 2/14* (2006.01)
*B41J 2/15* (2006.01)

(52) U.S. Cl.
CPC ..... *B41J 2/19* (2013.01); *B41J 2/1433* (2013.01); *B41J 2/15* (2013.01); *B41J 2/175* (2013.01); *B41J 2202/02* (2013.01)

(58) Field of Classification Search
CPC ..... B41J 2/19
See application file for complete search history.

(56) References Cited

U.S. PATENT DOCUMENTS 6,997,538 B1 * 2/2006 Kawamura ..... B41J 2/04526 347/21
2009/0179939 A1 * 7/2009 Ide ..... B41J 2/14032 347/21
2015/0375543 A1 * 12/2015 Barnett ..... B41J 2/04516 347/37

* cited by examiner

*Primary Examiner* — Alessandro Amari
*Assistant Examiner* — Roger W Pisha, II
(74) *Attorney, Agent, or Firm* — Canon U.S.A. Inc., IP Division

(57) ABSTRACT

Gas is blown at a predetermined speed from a predetermined area on an orifice substrate with reference to the position of an ejection port array.

15 Claims, 11 Drawing Sheets

FIG. 10A

| BLOWING WIDTH [μm] | MAXIMUM SPEED OF BLOWN GAS [m/s] |
|---|---|
| 200—600 | 6 |
| 100—200 | 7 |
| 50—100 | 8 |
| 30—50 | 13 |
| 10—30 | 18 |

FIG. 10B

| BLOWING WIDTH [μm] | SPEED RANGE OF BLOWN GAS [m/s] |
|---|---|
| 200—600 | 1—3 |
| 100—200 | 2—5 |
| 50—100 | 3—7 |
| 30—50 | 4—10 |
| 10—30 | 7—18 |

FIG. 10C

| | | AREA g | AREA f |
|---|---|---|---|
| ACTION | | ACTION 1 (+ ACTION 2 AT NEARLY MAXIMUM BLOWING SPEED) | ACTION 2 |
| RANGE OF BLOWING SPEED | UPPER LIMIT | SPEED AT WHICH GAS BLOWS BUT NO UNSTEADY FLOW IS GENERATED | SPEED AT WHICH GAS BLOWS BUT NO VORTEX IS GENERATED |
| | LOWER LIMIT | ABOUT 50% OF SPEED AT WHICH GAS BLOWS BUT NO VORTEX IS GENERATED | ABOUT 50% OF SPEED AT WHICH GAS BLOWS BUT NO VORTEX IS GENERATED |

ACTION 1: PREVENTING VORTEX FROM CURLING UP

ACTION 2: PREVENTING GAS ENTRAINMENT INVOLVING FORMING VORTEX OF DROPLETS

LIQUID EJECTION HEAD AND APPARATUS AND METHOD FOR PRINTING

BACKGROUND OF THE INVENTION

Field of the Invention

The present invention relates to a liquid ejection head and an apparatus and a method for printing on a printing medium by ejecting ink onto the printing medium.

Description of the Related Art

In ink-jet printing apparatuses, an example of a method for achieving high-speed printing is a method of reducing the number of times of scanning in printing and an example of a method for achieving high image quality is a method of decreasing the size of ink droplets. Examples of a method for achieving the above two methods without changing the size of the print head include a method of increasing the number of ink ejection ports by disposing ink ejection ports at high density and a method of increasing the frequency of ink ejection. However, it is known that printed images are affected by an airflow generated due to splashes of ejected ink droplets and an airflow generated due to the relative motion of the print head and the printing medium.

FIG. 11 is a diagram illustrating cylindrical vortices 12, which are airflows generated between a print head and a printing medium in a conventional ink-jet printing apparatus. As illustrated, airflows generated due to ejection of ink between the print head and the printing medium and airflows generated due to the relative motion of the print head and the printing medium interfere with each other to generate cylindrical vortices 12. Such vortices 12 can affect the landing positions of the ejected ink droplets. In particular, deviation of the landing positions of what is called satellite droplets accompanying main ink droplets and having diameters smaller than those of the main droplets cause streaks and turbulence like wind ripples, as observed on sand dunes, (hereinafter, referred to as wind ripples) to decrease the image quality.

FIG. 12 is a diagram illustrating a method of ink-jet printing disclosed in U.S. Pat. No. 6,997,538 B1.

In the method disclosed in U.S. Pat. No. 6,997,538 B1, in order to eliminate the cylindrical vortices 12 generated by droplets ejected from ink ejection port arrays forward of the moving direction of the print head, gas is introduced between a print head and a printing medium. However, the method disclosed in U.S. Pat. No. 6,997,538 B1 requires that the gas introduced have a sufficient flow rate to generate much more airflows than airflows generated due to the relative motion of the print head and the printing medium. Thus, the airflows caused by the introduced gas can significantly deviate the landing positions of the ejected ink droplets from desired landing positions. This can decrease the image quality.

The inventors found that when the ejection ports of the print head are disposed at high density, or when the ejection frequency is set relatively high, vortices generated between the print head and the printing medium can be unstable because of the unstable performance of the gas. The inventors also found that the unstable vortices can disturb the landing positions of the satellite droplets to generate streaks in the printed image or turbulence like wind ripples, as observed on sand dunes, to decrease the image quality (FIG. 11).

The present invention provides a liquid ejection head and an apparatus and a method of printing in which generation of wind ripples caused by the displacement of ink droplets landing positions is reduced or eliminated, enabling high-quality printing.

SUMMARY OF THE INVENTION

A liquid ejection head according to an aspect of the present invention includes an ejection port array and at least one gas blowing port disposed with reference to the ejection port array. The liquid ejection head is configured to eject droplets from the ejection port array to a printing medium while moving relative to the printing medium. The gas blowing port blows gas to an upstream side of an airflow generated in an area between an ejection port surface of the ejection port array and the printing medium while the liquid ejection head is moving relative to the printing medium. The liquid ejection head blows the gas from the gas blowing port at a predetermined speed during ejection of the droplets to change the orientation of an airflow of a vortex generated due to the ejection of the droplets to reduce the size of the vortex.

A recording apparatus according another aspect of the present invention includes the liquid discharge head.

A method for recording according to still another aspect of the present invention is a method for printing by ejecting droplets from an ejection port array of a liquid ejection head to a recording medium while the liquid ejection head is moving relative to the recording medium. The gas blowing port is disposed with reference to an ejection port surface of the ejection port array. The gas blowing port blows gas to an upstream side of an airflow generated within a distance between the ejection port surface and the printing medium while the liquid ejection head is moving. The gas blowing port blows the gas at a predetermined speed during ejection of the droplets to change the orientation of an airflow of a vortex generated due to the ejection of the droplets to reduce the size of the vortex.

Further features of the present invention will become apparent from the following description of exemplary embodiments with reference to the attached drawings.

BRIEF DESCRIPTION OF THE DRAWINGS

FIG. 10A is a list of the relationship between the widths of a gas blowing port and a gas blowing speed according to the first embodiment.

FIG. 10B is a list of the relationship between the widths of a gas blowing port and a gas blowing speed according to the second embodiment.

FIG. 10C is a list of the action of the blown gas on the vortex.

DESCRIPTION OF THE EMBODIMENTS

First Embodiment

A first embodiment of the present invention will be described hereinbelow with reference to the drawings.

Figure 1:
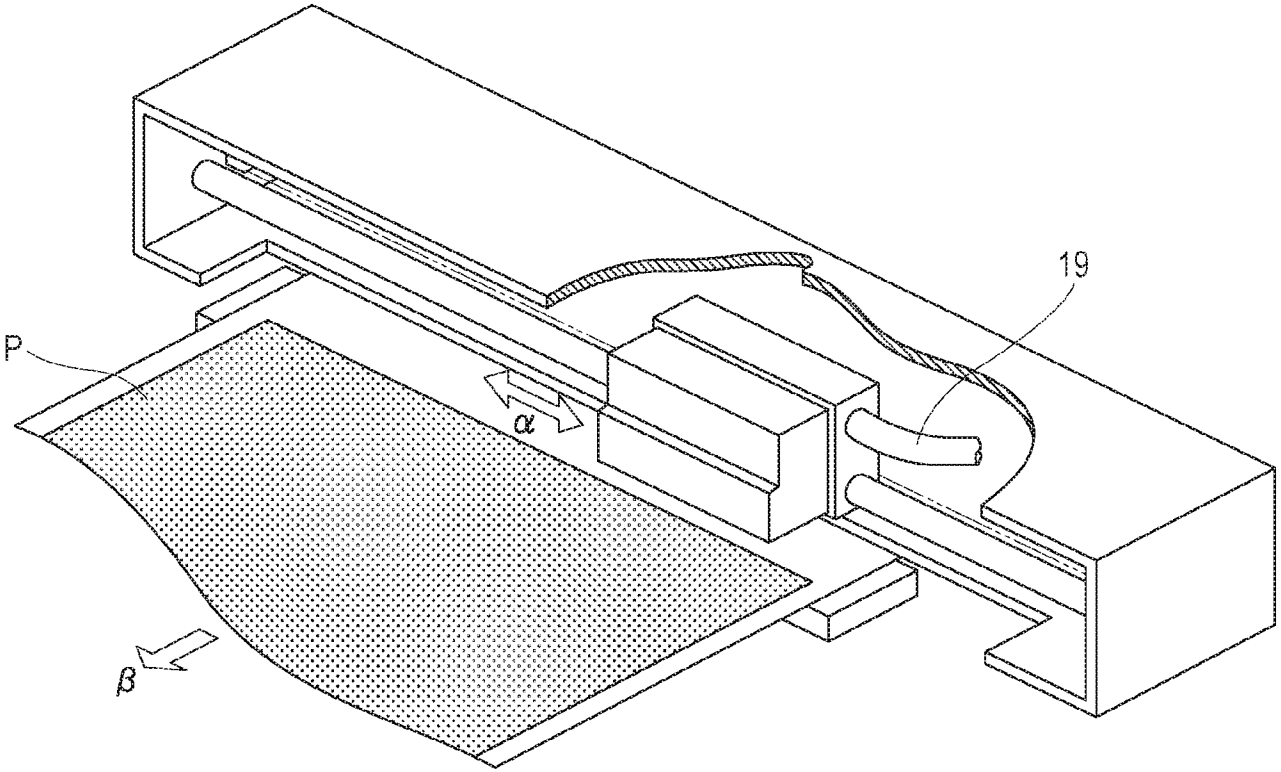
FIG. 1 is a schematic perspective view of a printing apparatus according to the first embodiment.

FIG. 1 is a schematic perspective view of an ink-jet printing apparatus, which is a printing apparatus that ejects liquid, according to the first embodiment. The printing apparatus of this embodiment prints on a printing medium P by alternately repeating the operation of ejecting ink while moving a print head mounted on a carriage back and forth (in the direction of arrow α) on the printing medium P and the operation of conveying the printing medium P in a subscanning direction (in the direction of arrow β). The print head of this embodiment is connected to a gas supply system, described later, with a tube 19, so as to blow gas supplied from the gas supply system.

Figure 2A:
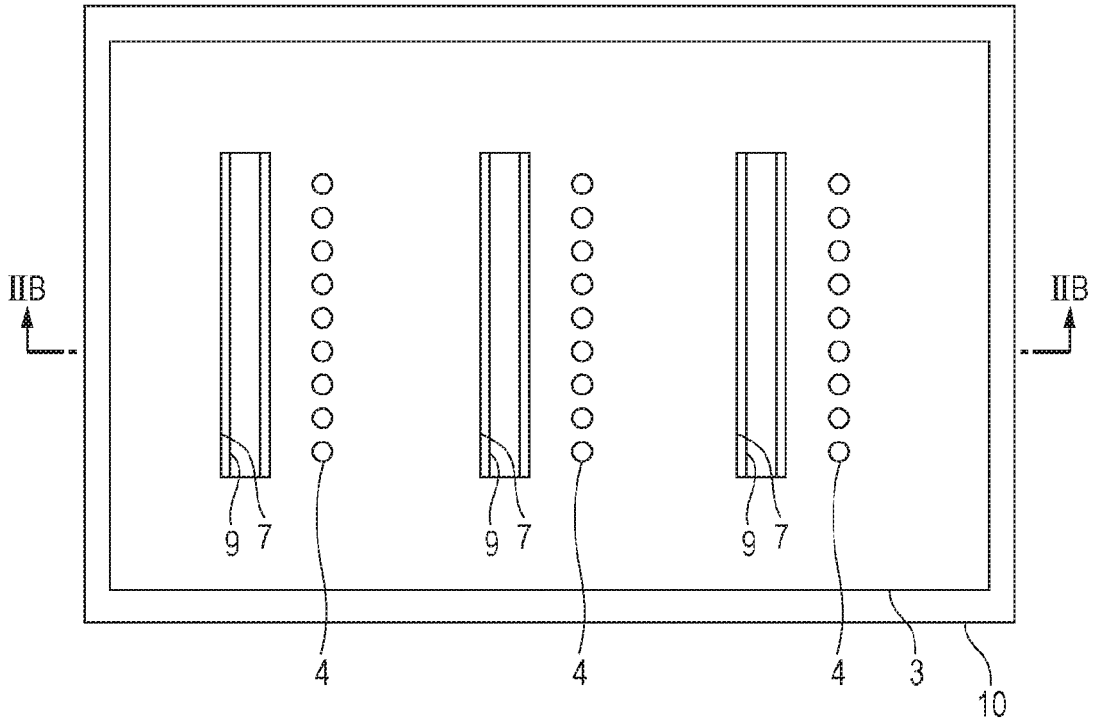
FIG. 2A is a plan view of a liquid ejection head applicable to the first embodiment of the present invention.
Figure 2B:
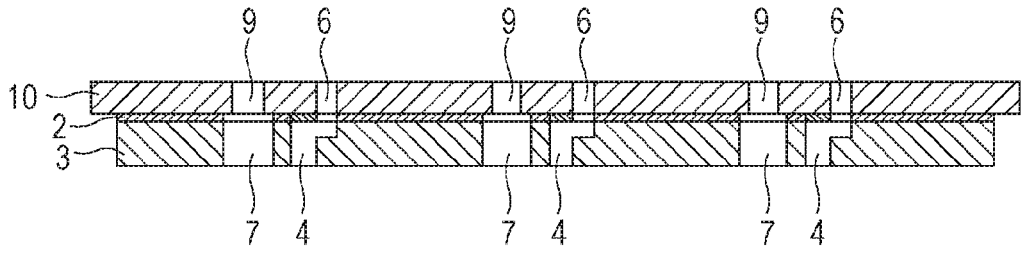
FIG. 2B is a cross-sectional view taken along line IIB-IIB in FIG. 2A.

FIGS. 2A and 2B and FIGS. 3A and 3B illustrate part of a liquid ejection head applicable to this embodiment. FIG. 2A is a plan view of the liquid ejection head viewed from a direction perpendicular to an orifice substrate surface in which ink ejecting orifices are disposed. FIG. 2B is a cross-sectional view taken along line IIB-IIB in FIG. 2A. The print head of this embodiment is configured such that a single orifice substrate 3 is disposed on a single device substrate 2, and a plurality of device substrates 2 are disposed on a supporting member 10. As illustrated, three ink ejection port arrays are formed in the orifice substrate 3. The number of ink ejection port arrays is not limited to three. In some embodiments, the number is one or plural. The orifice substrate 3 has gas blowing ports 7 communicating with gas supply ports 9 in the supporting member 10. The ink is supplied from a supply chamber 6 in the supporting member 10 through a supply passage 5 to a foaming chamber 13, where the ink is foamed by the heat of a heater 1 and is ejected as droplets from ink ejection ports 4 due to pressure during foaming. An ink-ejecting-energy generating element may be a piezoelectric element.

Figure 3A:
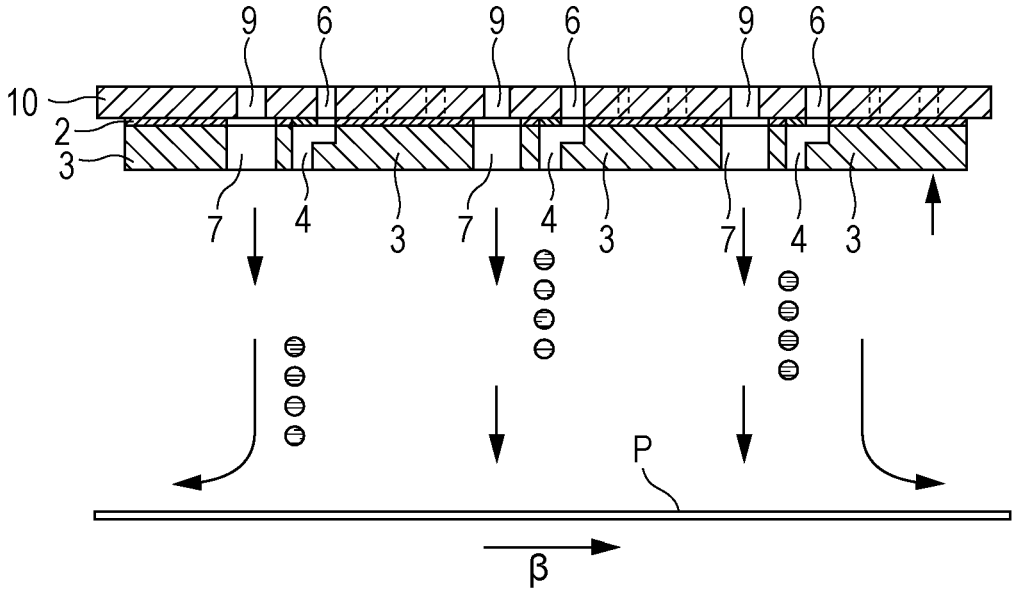
FIG. 3A is a diagram of the liquid ejection head applicable to the first embodiment of the present invention.

FIG. 3A illustrates the positional relationship between gas blown out of the gas blowing ports 7 (hereinafter referred to as gas) and ejected ink droplets in the print head of this embodiment. The ejected ink droplets are observed from a coordinate system fixed to the print head. The printing medium P moves from the left to the right on the plane of the drawing (in the direction of arrow β). The following is an observation in the coordinate system fixed to the print head. When the print head and the printing medium move relative to each other, the air between the print head and the printing medium P moves from the left to the right on the printing medium P. In other words, the gas blowing ports 7 are present upstream of the air moving between the print head and the printing medium P, and the ink ejection ports 4 are present downstream of the air. The print head of this embodiment is configured to be capable of ejecting six colors of ink. The plurality of ejection port arrays individually eject black, magenta, cyan, yellow, cyan, and magenta inks. The black and yellow ejection port arrays include ejection ports that eject droplets with a volume of 5 pl. The other color arrays each include ejection ports that eject droplets with volumes of 5 pl, 2 pl, and 1 pl.

Figure 3B:
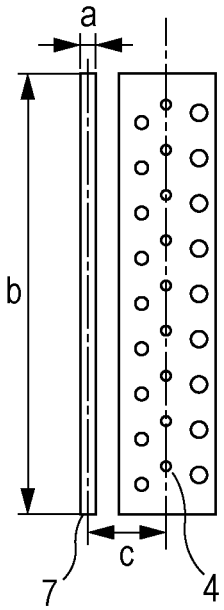
FIG. 3B is a front view of an ejection port array of the liquid ejection head.

FIG. 3B is a front view of an ejection port array that ejects cyan ink droplets. In this embodiment, the gas blowing ports 7 are each disposed with reference to an ejection port array that ejects 1 pl ink droplets, which is most susceptible to the blown gas (in this embodiment, air). The gas blowing ports 7 has a dimension a of 20 μm, and a dimension b of about 11 mm. The dimension b is preferably larger than the length of the ejection port arrays. In this embodiment, the gas blowing ports 7 are parallel to the ejection port arrays. The dimension c, which is the distance between the gas blowing port 7 and the reference ejection port array, will be described later.

Figure 4:
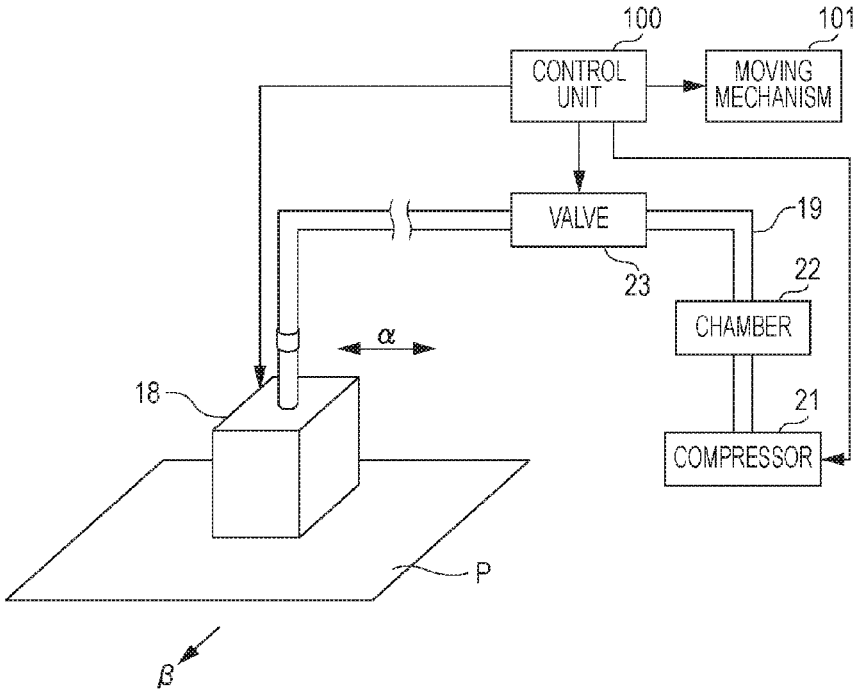
FIG. 4 is a schematic diagram of a gas supply system.

FIG. 4 is a schematic diagram of a gas supply system. A print head 18 and a compressor 21 are connected with a tube 19. A chamber 22 for reducing the pulsation of the compressor 21 may be disposed in an intermediate point of the tube 19, as illustrated. The system further includes a valve 23 for supplying gas as needed during printing in an intermediate point of the tube 19. If gases with different flow rates are to be ejected from a plurality of gas ejection ports, a plurality of valves 23 and tubes may be disposed. The tube 19 for supplying gas may be a flexible tube to supply gas regardless of the position of the moving print head 18. The gas comprises various gases including air. The compressor 21 and the valve 23 are controlled by a control unit 100. The control unit 100 may control the entire printing apparatus. In this case, the control unit 100 performs control for ejecting ink droplets from the ink ejection ports 4 of the print head 18 and control of a moving mechanism 101 for moving the print head 18 and the printing medium P relative to each other. In this embodiment, the moving mechanism 101 includes a mechanism for moving the print head 18 in a main scanning direction and a mechanism for conveying the printing medium P in the subscanning direction.

Figure 5A:
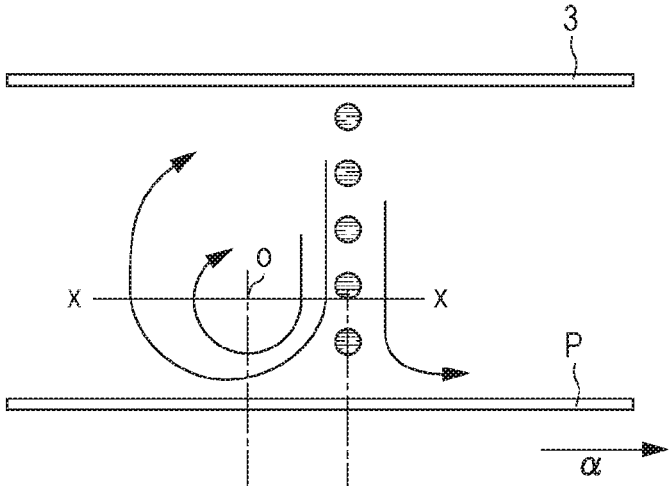
FIG. 5A is a schematic diagram of a cylindrical vortex generated due to ejected ink droplets.
Figure 5B:
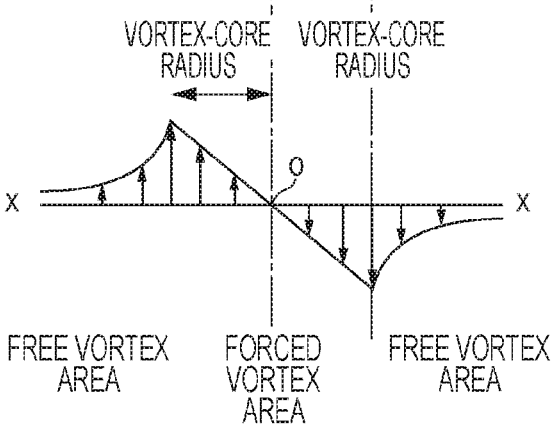
FIG. 5B is a diagram illustrating components of velocity in a direction perpendicular to the printing medium P on a line x-x passing through a vortex center o in FIG. 5A.

FIGS. 5A and 5B are diagrams illustrating a cylindrical vortex (hereinafter simply referred to as "vortex") 12 generated due to the ejected ink droplets. FIG. 5A is a schematic diagram of the vortex 12. FIG. 5B illustrates components of velocity in a direction perpendicular to the printing medium P on a line X-X passing through a vortex center o in FIG. 5A. When ink is ejected from an ejection port array of the print head 18, an airflow can be generated in the air around the droplets to generate the vortex 12 between the surface of the ejection ports 4 of the ejection port array and the printing medium P, as illustrated. The vortex 12 is generated because an airflow flowing from the print head 18 toward the printing medium P impinges on the printing medium P and turns back. An area in which the velocity of the airflow in the vortex 12 is proportional to a distance from the vortex center o is referred to as a forced vortex area, and an area outside the forced vortex area, in which the velocity is attenuated, is referred to as a free vortex area. The forced vortex area is also referred to as a vortex core, the radius of the vortex core is referred to as a vortex core radius, and a maximum value in a vortex core radius distribution in the direction of the ejection port array is referred to as a maximum vortex core radius. In this example, when the moving speed of the printing medium P is 0.635 m/s, the maximum vortex core radius (an area f in FIG. 6A) of the cylindrical vortex 12 generated from an ejection port array that ejects printing droplets with a volume of about 1 pl from 256 ejection ports and having an ejection frequency of 15 kHz is about 300 μm.

The following is the action of gas blown to the cylindrical vortex 12 when magenta or cyan droplets with a volume of 1 pl is ejected. Although this embodiment has a single gas blowing port 7 for each ejection port array, a plurality of gas blowing ports may be disposed for each ejection port array. The action of this case is substantially the same as that when a single blown gas acts on a single vortex 12. The present invention is applicable to cylindrical vortices 12 generated due to droplets with volumes of 2 pl and 5 pl, as well as the cylindrical vortex 12 generated due to droplets with a volume of 1 pl.

Figure 6A:
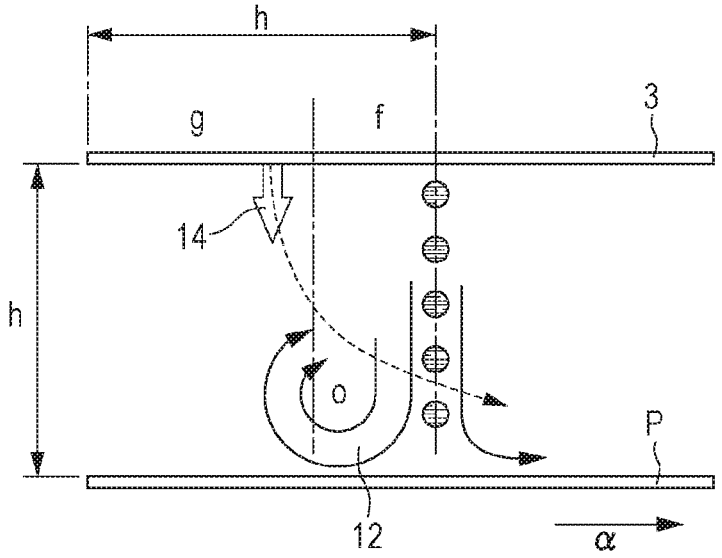
FIG. 6A is a diagram illustrating a state in which gas acts on a cylindrical vortex.
Figure 6B:
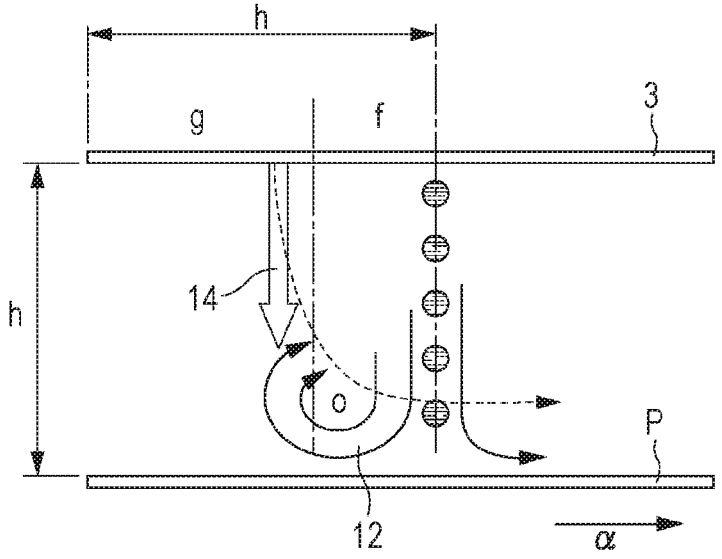
FIG. 6B is a diagram illustrating a state in which gas acts on a cylindrical vortex.

FIGS. 6A and 6B are diagrams illustrating the action of the blown gas 14 on the cylindrical vortex 12 generated due to ejection of droplets. FIG. 6A illustrates a state in which the gas blowing speed is near the lowest speed, and FIG. 6B illustrates a state in which the gas blowing speed is substantially twice that of FIG. 6A. The gas blowing speed is a speed at which the gas 14 is blown from the gas blowing port 7. An area g is an area equal to or larger than the maximum vortex core radius (the area f) and less than the distance h between the print head 18 and the printing medium P (hereinafter referred to as "head-to-medium distance") distant upstream from the ejection port array on the orifice substrate 3. The blowing angle of the gas 14 is within 90±5° with respect to the orifice substrate 3 in both of FIGS. 6A and 6B.

If no gas is blown in a printing area in which disturbance in landing position is a problem, a distribution of landing positions of satellite droplets ejected from an ejection port array with an ejection volume of 1 pl, an ejection port number of 256, and an ejection frequency of 15 kHz deviates about ±15 μm at the maximum from reference positions. To contract and stabilize the vortex 12, the gas 14 with a speed of about 8 m/s is blown from the gas blowing port 7 in the area g with a blowing width (the dimension a in FIG. 3B) 20 μm and a blowing position of 500 μm (the dimension c in FIG. 3B). This stabilizes the landing positions of the satellite droplets, allowing the deviation from the reference positions to be within about ±6 μm at the maximum. Also for the main droplets, the deviation of the landing positions is improved from about ±5 μm to about ±2 μm. Furthermore, we found that the deviation of the landing positions from the reference position in the carriage moving direction is within an amount that causes no problem for bidirectional printing.

Here is a comparison of the flow rate of a blown airflow between this embodiment and U.S. Pat. No. 6,997,538 B1. In U.S. Pat. No. 6,997,538 B1, gas is blown to an area between the print head and the printing medium so that an airflow with speeds of about 0.5 to 2.0 m/s flows. Assuming that the distance between the print head and the printing medium is 1.25 mm, and the length of the ejection port array is 11 mm, which is the same as the length in this embodiment, and the blowing speed is a minimum value 0.5 m/s, the flow rate is about 6.9 ml/s. In contrast, the flow rate in this embodiment is about 1.8 ml/s since the ejection port array has a blowing width of 20 μm and a length of 11 mm in the direction of the ejection port array, and the blowing speed is 8 m/s. Thus, the flow rate of the blown gas 14 in this embodiment is about one fourth the flow rate in U.S. Pat. No. 6,997,538 B1. This efficiently reduces or eliminates disturbance in airflow due to the vortex 12 at such a low flow rate. Furthermore, the flow rate of the blown gas 14 is so low that the airflow of the blown gas 14 has little effect on the droplets, and therefore the deviation of the landing positions is small, having little possibility of degrading the image quality. The following is a reason for the improvement in the distribution of the landing positions of droplets. As indicated by the dotted line in FIG. 6A, the airflow of the gas 14 blown from the gas blowing ports 7 in the orifice substrate 3 interferes with the vortex 12. In other words, the airflow of the curling-up vortex 12 generated due to the ejection of droplets and the airflow of the blown gas 14 interfere with each other (intersect) to retard the growth of the vortex 12, substantially reducing the size of the vortex 12.

FIG. 6B illustrates an example in which the blowing speed of the gas 14 is higher than that in FIG. 6A. The airflow of the gas 14 that is blown from the area g at a speed of 14 m/s, which is higher than a speed of 8 m/s, and the airflow of the vortex 12 interfere with each other. The action of the blown gas 14 to retard the growth of the cylindrical vortex 12 in this method is the same as the action shown in FIG. 6A. In this method, the airflow due to the gas 14 curls up beyond the curl of the vortex 12 because of the high blowing speed of the gas 14, causing another action. This action will be described. The blown gas 14 is let flow in the moving direction of the printing medium P (the direction of arrow α) to form a flow crossing the airflow generated due to ejection of the droplets. In other words, the airflow generated due to ejection of the droplets interferes with the airflow of the blown gas 14 at a position ahead of the vortex 12. This prevents the airflow generated due to the ejection of the droplets from being taken into the vortex 12. This retards the growth of the vortex 12. Thus, by increasing the blowing speed of the gas 14, the two actions are exerted on the vortex 12 to reduce the size of the entire vortex 12, thereby stabilizing it. We found that if the gas blowing speed is 14 m/s under the same conditions for the shape of the gas blowing ports 7 and the ejected droplets for printing as those of FIG. 6A, wind ripples are reduced or eliminated. Furthermore, the deviation of the landing positions of the ejected droplets from the reference position in the carriage moving direction is also within an amount that causes no problem for bidirectional printing.

The blowing speed of the gas 14 is preferably within a range in which the flow of the blown gas 14 would maintain a laminar flow. This is because if the gas 14 becomes a transitional flow or a turbulent flow, the gas 14 changes in speed temporally and spatially, disturbing the landing positions of the satellite droplets.

The width a (see FIG. 3B), which is the length of the gas blowing port 7 in the crosswise direction, and the gas blowing speed have close relationship. Optimum relationship is listed in FIG. 10A.

The blown gas (in this embodiment, air) may be humidified air. Using humidified air as the gas would have the advantage of preventing ink ejected from the ejection port array from drying.

The blown gas may be cooled gas. Using cooled gas allows the print head to be cooled, thus preventing the print head from increasing in temperature.

Thus, gas is blown at a predetermined speed from an area equal to or larger than the maximum vortex core radius and less than the head-to-medium distance h distant upstream from the ejection port array on the orifice substrate 3. This prevents generation of wind ripples due to deviation of the landing positions of the ejected ink droplets, providing a liquid ejection head and a printing apparatus capable of high-quality printing.

Second Embodiment

A second embodiment of the present invention will be described with reference to the drawings. The basic configuration of this embodiment is the same as that of the first embodiment, and therefore only the distinctive configuration of this embodiment will be described.

Figure 7A:
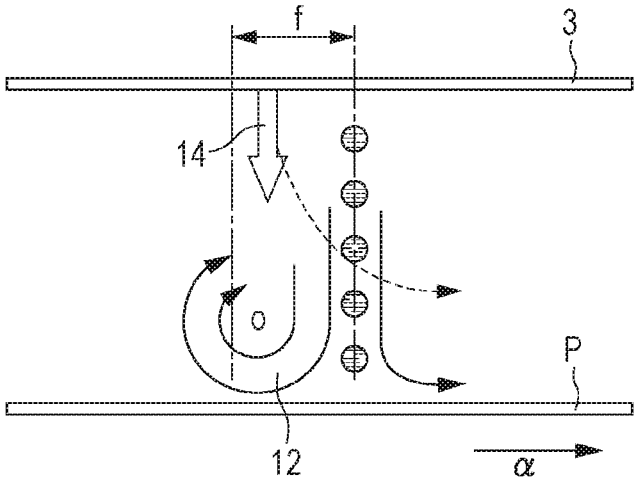
FIG. 7A is a diagram an airflow generated due to ejected droplets according to a second embodiment of the present invention.
Figure 7B:
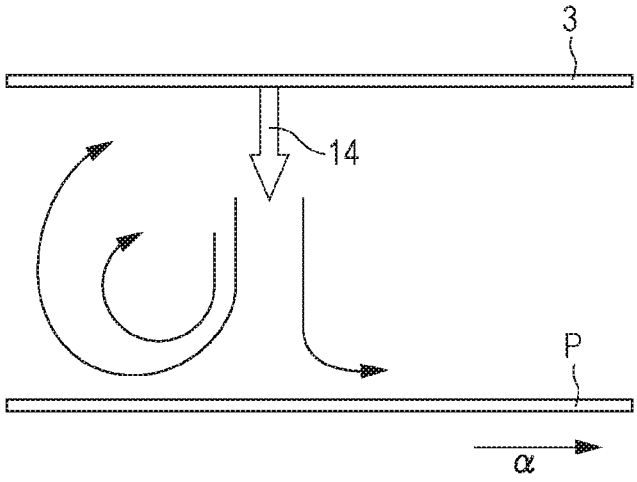
FIG. 7B is a diagram an airflow generated due to ejected droplets according to the second embodiment.

FIGS. 7A and 7B are diagrams of an airflow due to the blown gas 14. FIG. 7A illustrates a state in which the gas 14 blown from an area f interferes with the vortex 12 generated due to ejection of droplets. The difference in configuration between this embodiment and the first embodiment is that the blowing position of the gas 14 differs. The area f, which is the blowing position of the gas 14 in this embodiment, is an area on the orifice substrate 3 upstream within the maximum vortex core radius of the vortex 12 from the ejection port array. The range of the blowing speed of the gas 14 blown from the area f will now be described. The range of the blowing speed of the gas 14 is obtained as follows. As shown in FIG. 7B, only the gas 14 is blown from the gas blowing port 7 (no printing droplets are ejected) while the printing medium is being moved, and the speed of the blown gas 14 is gradually increased. The maximum speed of the gas 14 at which no vortex is generated ahead in the print head moving direction is obtained. This value is the maximum blowing speed of the gas 14. The gas 14 is blown at a speed equal to or lower than the maximum speed obtained. The reason only the gas 14 is blown for evaluation is that the blown gas 14 contributes to formation of the vortex 12 more than ejected droplets. Furthermore, we found that the lower limit of the blowing speed is about 50% of the maximum blowing speed. The gas 14 is blown in the ejecting direction of the droplets at angles within 90±5° to the orifice substrate 3.

The effects of the blowing of the gas 14 in this embodiment will be described in comparison with the related art. Unless the gas 14 is blown, the distribution of the landing positions of satellite droplets ejected from an ejection port array with an ejection volume of about 1 pl, an ejection port number of 256, and an ejection frequency of 15 kHz deviates at a maximum of about ±15 μm from reference positions. For this reason, by blowing the gas 14 at a speed of about 10 m/s from the area g with a blowing port width of 20 μm and a blowing position of 210 μm (the dimension c in FIG. 3B), the vortex 12 is reduced in size and stabilized. This stabilizes the landing positions, allowing the maximum value of the distribution of the landing positions in a printing area in which disturbance of landing positions causes a problem to be within about ±7 μm. Also for the main droplets, the deviation of the landing positions is improved from about ±5 μm to about ±2 μm. Furthermore, we found that the deviation of the landing positions from the reference position in the recording head moving direction is within an amount that causes no problem for bidirectional printing. Furthermore, the flow rate of the blown gas 14 is lower than that of the related art, as in the first embodiment.

The following is a reason for the improvement in the distribution of the landing positions of droplets.

As indicated by the dotted line in FIG. 7A, the gas 14 blown from the gas blowing port 7 in the orifice substrate 3 is let flow in the moving direction of the printing medium P. The droplets ejected from the orifice substrate 3 splash while entraining surrounding air and collide with an airflow from the front to generate the vortex 12. The airflow of the blown gas 14 is made to interfere with the portion at which the entrained air collides with the vortex 12 to prevent the entrained air from being taken in the vortex 12. This would prevent the vortex 12 from developing. In other words, the vortex 12 as a whole is reduced in size and stabilized, so that wind ripples are efficiently eliminated, improving the printing quality. Optimum relationship between the width a of the gas blowing port 7 (see FIG. 3B) and the gas blowing speed in this embodiment is listed in FIG. 10B.

The action of the gas 14 on the vortex 12 in the first embodiment and this embodiment cannot be distinctly separated because of the continuity of the fluid phenomenon. However, the effect of preventing the vortex 12 from curling up seems to be the main operational advantage in the area g, and the effect of droplets reducing the amount of entrained gas involving formation of the vortex 12 seems to be the main operational advantage in the area f. FIG. 10C lists the action of the blown gas 14 on the vortex 12.

As described above, during ejection of ink, gas is blown at a predetermined speed from an area within a maximum vortex core radius upstream from the ejection port array on the orifice substrate 3. This prevents generation of wind ripples due to deviation of the landing positions of the ejected ink droplets, providing a liquid ejection head and a printing apparatus capable of high-quality printing.

Third Embodiment

A third embodiment of the present invention will be described with reference to the drawings. The basic configuration of this embodiment is the same as that of the first embodiment, and therefore only the distinctive configuration of this embodiment will be described.

Figure 8A:
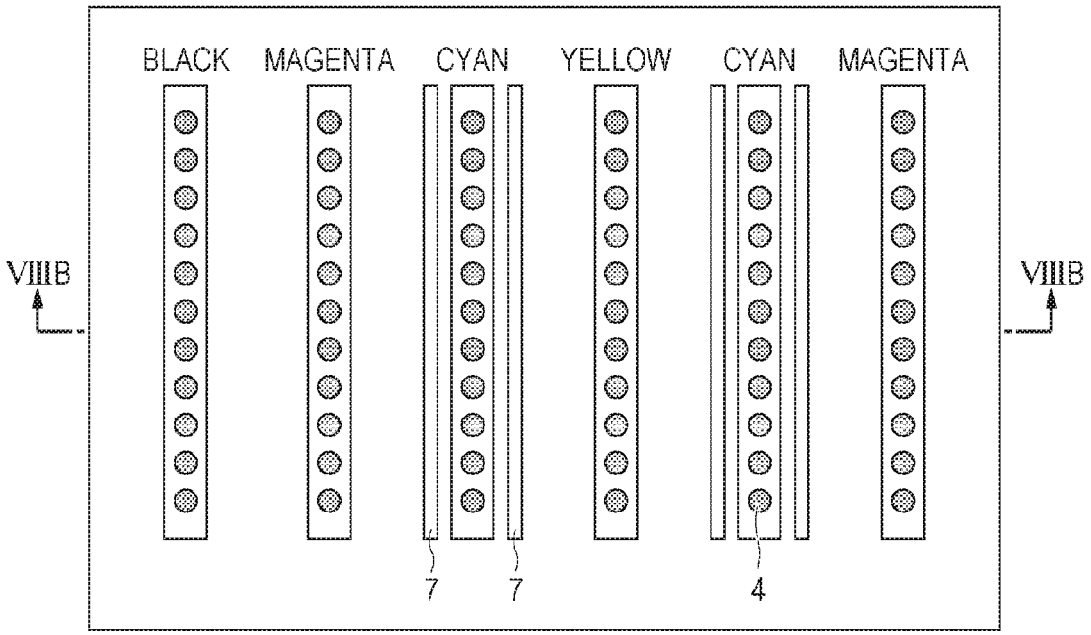
FIG. 8A is a plan view of a liquid ejection head according to a third embodiment of the present invention.
Figure 8B:
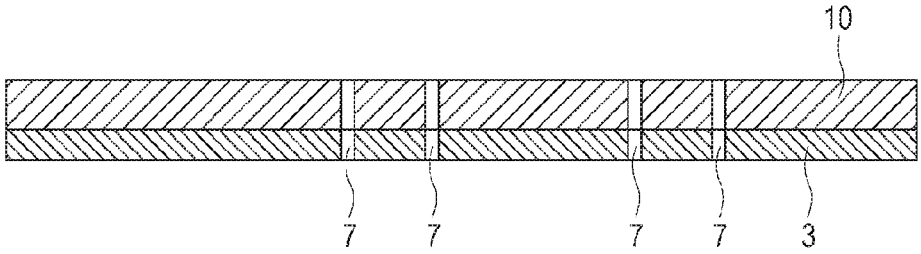
FIG. 8B is a cross-sectional view taken along line VIIIB-VIIIB in FIG. 8A.

FIGS. 8A and 8B illustrate a liquid ejection head of this embodiment. FIG. 8A is a plan view of the liquid ejection head as viewed from a direction perpendicular to the surface of the orifice substrate 3, and FIG. 8B is a cross-sectional view taken along line VIIIB-VIIIB in FIG. 8A. FIGS. 8A and 8B illustrate an example in which gas blowing ports 7 are provided for ejection port arrays that eject cyan ink.

As illustrated, the liquid ejection head of this embodiment is characterized by including two gas supply ports 9 for each ejection port array. The gas supply port 9 provided for each ejection port array that ejects cyan ink in FIG. 8B is supplied with gas from the gas supply system (see FIG. 4). The gas supply ports 9 pass through the supporting member 10 and are supplied with gas from the back of the supporting member 10. The gas supply system shown in FIG. 4 may comprises a plurality of gas supply systems so that gases with different flow rates may be supplied to the gas supply ports 9. For bidirectional printing, airflows can be always blown to the ink ejection port arrays from the upstream side by switching between the blowing positions.

In this way, during ejection of ink, gas is blown at a predetermined speed from a predetermined area upstream or downstream of each ejection port array on the orifice substrate 3. This prevents generation of wind ripples due to deviation of the landing positions of the ejected ink droplets, providing a liquid ejection head and a printing apparatus capable of high-quality printing.

Fourth Embodiment

A fourth embodiment of the present invention will be described with reference to the drawings. The basic configuration of this embodiment is the same as that of the first embodiment, and therefore only the distinctive configuration of this embodiment will be described.

Figure 9:
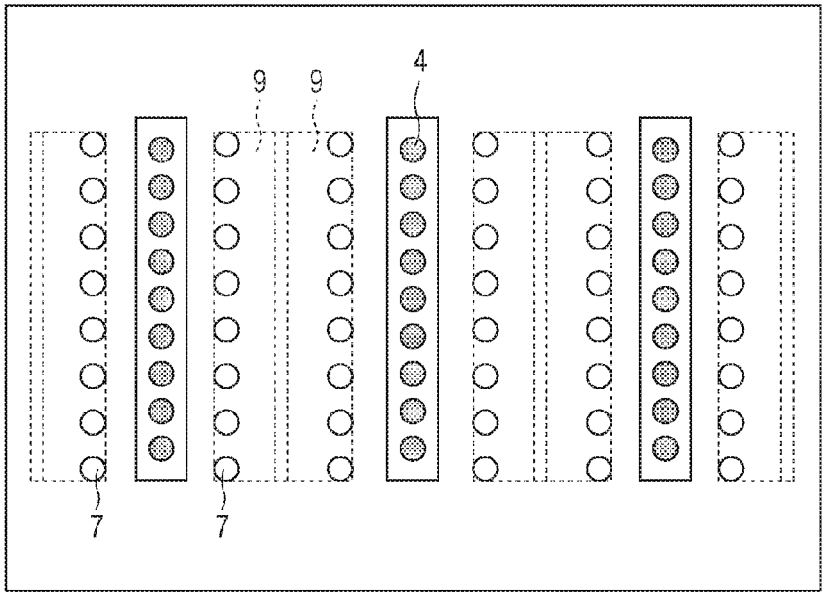
FIG. 9 is a diagram of a liquid ejection head according to a fourth embodiment of the present invention.
Figure 11:
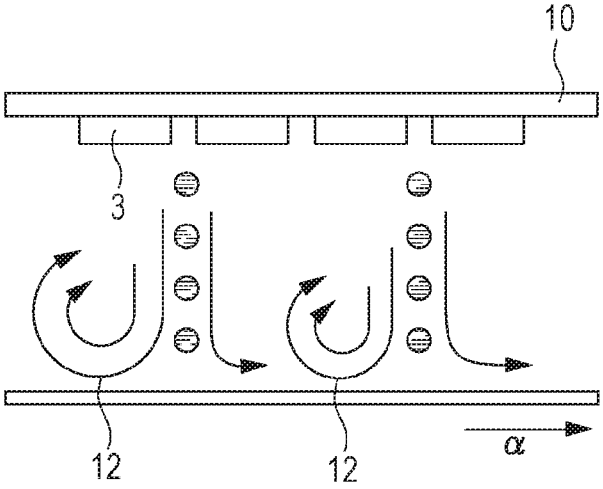
FIG. 11 PRIOR ART
FIG. 11 is a diagram illustrating cylindrical vortices, which are turbulent airflows generated between a print head and a printing medium in a printing apparatus in the related art.
Figure 12:
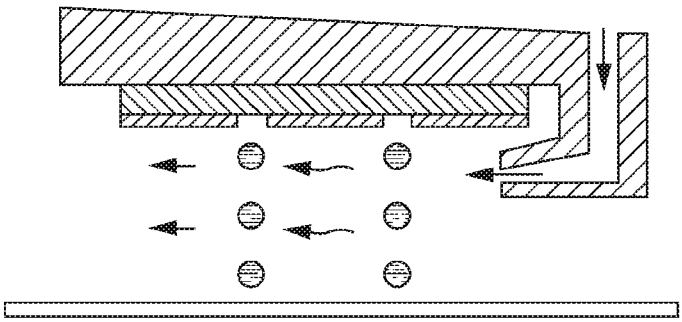
FIG. 12 PRIOR ART
FIG. 12 is a diagram illustrating a method of printing disclosed in the related art.

FIG. 9 illustrates a liquid ejection head of this embodiment. The liquid ejection head of this embodiment is characterized in that the gas blowing port 7 is not rectangular but circular in shape. The gas blowing port 7 may be elliptical or polygonal. The gas blowing port 7 of this embodiment has a diameter of about 20 μm. By disposing circular gas blowing ports 7 discretely, the total blowing area is smaller than that of a single rectangular gas blowing port. If efficient airflow control with a lower flow rate is needed, the gas blowing ports 7 may be disposed discretely, as in this embodiment.

Thus, during ejection of ink, gas is blown at a predetermined speed from a predetermined area upstream or downstream of each ejection port array on the orifice substrate 3. This prevents generation of wind ripples due to deviation of the landing positions of the ejected ink droplets, providing a liquid ejection head and a printing apparatus capable of high-quality printing.

Other Embodiments

The present invention is also applicable to various types of printing apparatus, such as a full-line printing apparatus, in addition to the serial-scan printing apparatus, described above. The full-line printing apparatus employs a long print head extending along the width of a printing medium and ejects ink from the print head while continuously moving the printing medium at a position facing the print head to continuously print images on the printing medium. It is only required that printing apparatuses to which the present invention is applicable be capable of printing images with the relative movement of the print head and the printing medium, that is, at least one of the print head and the printing medium should be moved.

In some embodiments of the present invention, a liquid ejection head has a gas blowing port within the distance between the ejection port surface of an ink ejection port array and a recording medium from the ejection port array upstream of an airflow generated during moving. By blowing gas from the gas blowing port at a predetermined speed during ejection of droplets, the direction of the airflow of a vortex generated due to the ejection of the droplets is changed so that the vortex is reduced in size. This prevents generation of wind ripples due to deviation of the landing positions of the ejected ink droplets, providing a liquid ejection head and a printing apparatus capable of high-quality printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-041743, filed Mar. 3, 2015, which is hereby incorporated by reference herein in its entirety.

What is claimed is:

1. A liquid ejection head comprising:

an ejection port array that ejects droplets to a printing medium while moving relative to the printing medium; and at least one gas blowing port disposed with reference to the ejection port array that blows gas as the ejection port array ejects droplets to the printing medium, wherein the gas blowing port blows gas, where the gas is blown at a speed equal to or lower than a maximum speed at which no vortex due to the gas is generated when only the gas is blown from the gas blowing port, to an upstream side of an airflow of a vortex generated in an area between an ejection port surface of the ejection port array and the printing medium while the liquid ejection head is moving relative to the printing medium, the gas blowing port being disposed at a position within a distance between the ejection port surface and the printing medium from the ejection port array.

2. The liquid ejection head according to claim 1, wherein the gas blowing port is parallel to the ejection port array.

3. The liquid ejection head according to claim 1, wherein the gas is blown within a speed at which the gas can maintain a laminar flow.

4. The liquid ejection head according to claim 1, wherein the gas is blown in a direction in which the droplets are ejected.

5. The liquid ejection head according to claim 1, wherein the gas blowing port is disposed within an area with length equal to or larger than a maximum vortex core radius of the vortex and less than a distance between the liquid ejection head and the printing medium distant from the ejection port array upstream of the airflow generated in the distance while the liquid ejection head is moving relative to the printing medium.

6. The liquid ejection head according to claim 5, wherein the gas is blown in such a manner as to intersect an airflow curling up in the vortex.

7. The liquid ejection head according to claim 1, wherein the gas blowing port is disposed within an area with length less than a maximum vortex core radius of the vortex distant from the ejection port array upstream of the airflow generated in a distance between the liquid ejection head and the printing medium while the liquid ejection head is moving relative to the printing medium.

8. The liquid ejection head according to claim 1, wherein the gas is blown in such a manner as to cross an airflow directed from the ejection port surface toward the vortex.

9. The liquid ejection head according to claim 1, wherein the at least one gas blowing port comprises a plurality of circular or elliptical ports.

10. The liquid ejection head according to claim 1, further comprising a gas supply system configured to blow the gas from the gas blowing port.

11. The liquid ejection head according to claim 1, wherein the gas comprises air.

12. The liquid ejection head according to claim 1, wherein the gas blown from the gas blowing port merges with the vortex caused by ejection of the droplets.

13. A printing apparatus comprising:

an ejection port array that ejects droplets to a printing medium while moving relative to the printing medium;

at least one gas blowing port disposed with reference to the ejection port array that blows gas as the ejection port array ejects droplets to the printing medium; and a gas supply system communicating with the gas blowing port, wherein the gas blowing port blows gas, where the gas is blown at a speed equal to or lower than a maximum speed at which no vortex due to the gas is generated when only the gas is blown from the gas blowing port, to an upstream side of an airflow of a vortex generated in an area between an ejection port surface of the ejection port array and the printing medium while the liquid ejection head is moving relative to the printing medium, the gas blowing port being disposed at a position within a distance between the ejection port surface and the printing medium from the ejection port array.

14. A method for printing, the method comprising:

ejecting droplets from an ejection port array to a printing medium while moving relative to the printing medium; and blowing gas from at least one gas blowing port disposed with reference to the ejection port array where the gas blowing port blows gas as the ejection port array ejects droplets to the printing medium, wherein the gas blowing port blows gas, where the gas is blown at a speed equal to or lower than a maximum speed at which no vortex due to the gas is generated when only the gas is blown from the gas blowing port, to an upstream side of an airflow of a vortex generated in an area between an ejection port surface of the ejection port array and the printing medium while the liquid ejection head is moving relative to the printing medium, the gas blowing port being disposed at a position within a distance between the ejection port surface and the printing medium from the ejection port array.

15. The method according to claim 14, wherein the gas blown from the gas blowing port merges with the vortex generated due to the ejection of the droplets.

* * * * *